US006171172B1

(12) United States Patent
Foster et al.

(10) Patent No.: US 6,171,172 B1
(45) Date of Patent: Jan. 9, 2001

(54) TOY THAT SENSES OBSTACLES TO ACTIVATE SOUND AND TURNING

(75) Inventors: George Foster, Long Beach, CA (US); Elliot A. Rudell, 1619 Gramercy Ave., Torrance, CA (US) 90501; Roger Gardner, Lomita, CA (US); Raymond Earl Fisher, Torrance, CA (US)

(73) Assignee: Elliot A. Rudell, Torrance, CA (US)

( * ) Notice: Under 35 U.S.C. 154(b), the term of this patent shall be extended for 0 days.

(21) Appl. No.: 09/466,020

(22) Filed: Dec. 17, 1999

(51) Int. Cl.[7] ..... A63H 17/40; A63H 5/00
(52) U.S. Cl. ..... 446/441; 446/270
(58) Field of Search ..... 446/441, 442, 446/454, 460, 468, 175, 270, 272, 297, 298, 300

(56) References Cited

U.S. PATENT DOCUMENTS 3,102,363 * 9/1963 Ferriot ..... 446/441
3,386,406 * 6/1968 Tsunoda ..... 446/441
4,198,049 * 4/1980 Kurita ..... 273/119
4,453,340 * 6/1984 Kozuka et al. ..... 446/437
4,563,162 * 1/1986 Ishimoto ..... 446/175
4,662,854 * 5/1987 Fang ..... 446/175
4,828,525 * 5/1989 Okano ..... 446/175
5,630,743 * 5/1997 Shi ..... 446/175
5,709,583 * 1/1998 Suto et al. ..... 446/440
5,908,345 * 6/1999 Choi ..... 446/436

* cited by examiner

*Primary Examiner*—D. Neal Muir
(74) *Attorney, Agent, or Firm*—Irell & Manella LLP

(57) ABSTRACT

A toy that can move around an object. The toy includes a drive mechanism that can move a housing in either a first direction or a second direction. The toy also includes a sensor that can be used to remotely sense an object. The sensor and drive mechanisms are coupled to a controller that can change the direction of the housing when the object is remotely sensed through the sensor.

13 Claims, 3 Drawing Sheets

TOY THAT SENSES OBSTACLES TO ACTIVATE SOUND AND TURNING

BACKGROUND OF THE INVENTION

1. Field of the Invention

The present invention relates to a motorized electric toy that can remotely sense and avoid an object.

2. Background Information

There have been developed a number of toys that emit sounds or move body parts in response to a change of environment. Tiger Electronics sold a toy under the trademark FURBY that would emit speech and move body parts in response to changes in light or movement of the toy. For example, the toy would open its eyes when exposed to light. The FURBY doll had no means to move across a surface.

Tyco Preschool sold a toy set under the trademark ELMO AND HIS DOG. The toy set included a dog which contained a receiver and an "ELMO" character that had a transmitter. Pressing the ELMO character would cause the transmitter to transmit signals to the receiver and move the dog. The child could control the movement of the dog through the ELMO character. If the dog encountered an object the child would have to press the ELMO character to move the toy dog around the object. The dog had no means to move around the object without the child's input.

There have been other walking toy dogs such as a product sold by Toybiz under the trademark POOCH THE GOOD PUPPY. The Toybiz dog would move toward a child who emitted a sound. The toy dog also contained a number of buttons that could be depressed to initiate a movement of the dog. For example, the toy would sit when a button was depressed on the dog's back. Toymax marketed a toy dog that would lift its leg and release a liquid when a child squeezed a bone attached to the dog. None of these toys could sense and move around an object.

SUMMARY OF THE INVENTION

One embodiment of the present invention includes a toy that can move around an object. The toy includes a drive mechanism that can move a housing in either a first direction or a second direction. The toy also includes a sensor that can be used to remotely sense an object. The sensor and drive mechanisms are coupled to a controller that can change the direction of the housing when the object is remotely sensed through the sensor.

DETAILED DESCRIPTION

Figure 1:
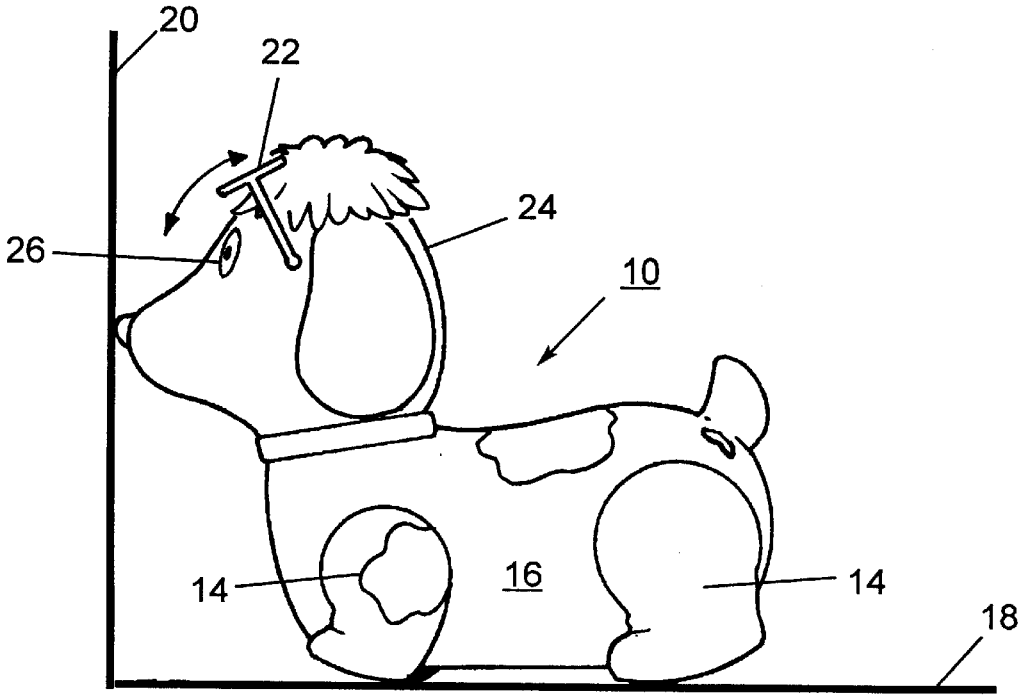
FIG. 1 is a side view of an embodiment of a toy of the present invention engaging a wall.

Referring to the drawings more particularly by reference numbers, FIGS. 1, 2, 3 and 4 show an embodiment of a toy 10 of the present invention. The toy 10 may include a housing 12 that is constructed to simulate a dog. The dog housing 12 may have a plurality of legs 14 that are coupled to a body 16. The toy dog 10 can move across a surface 18. Although a housing constructed as a dog is shown and described, it is to be understood that the housing may simulate other objects such as a toy vehicle.

Figure 2:
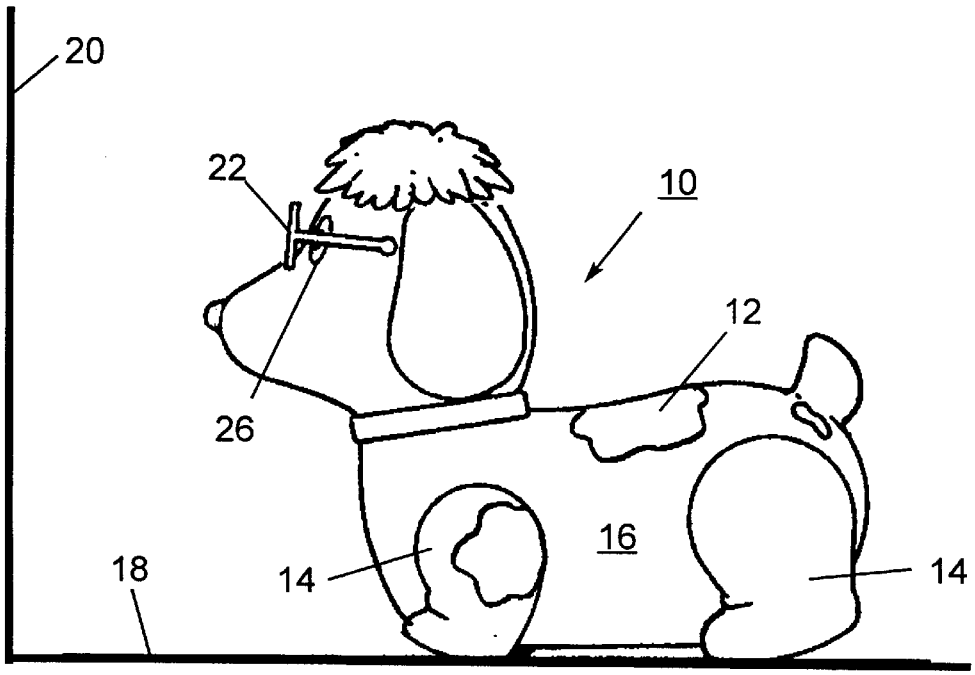
FIG. 2 is a side view of the toy operating in a different mode.
Figure 3:
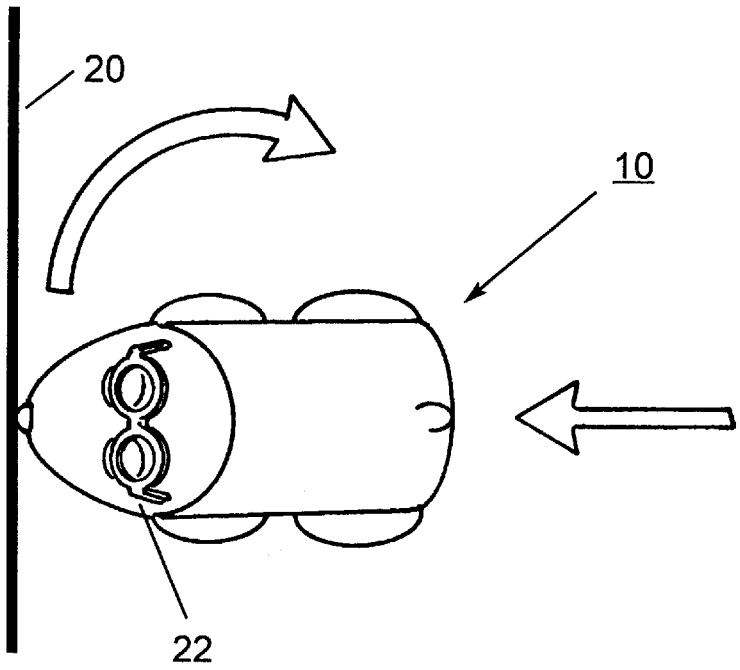
FIG. 3 is a top view of the toy operating in the mode shown in FIG. 1.
Figure 4:
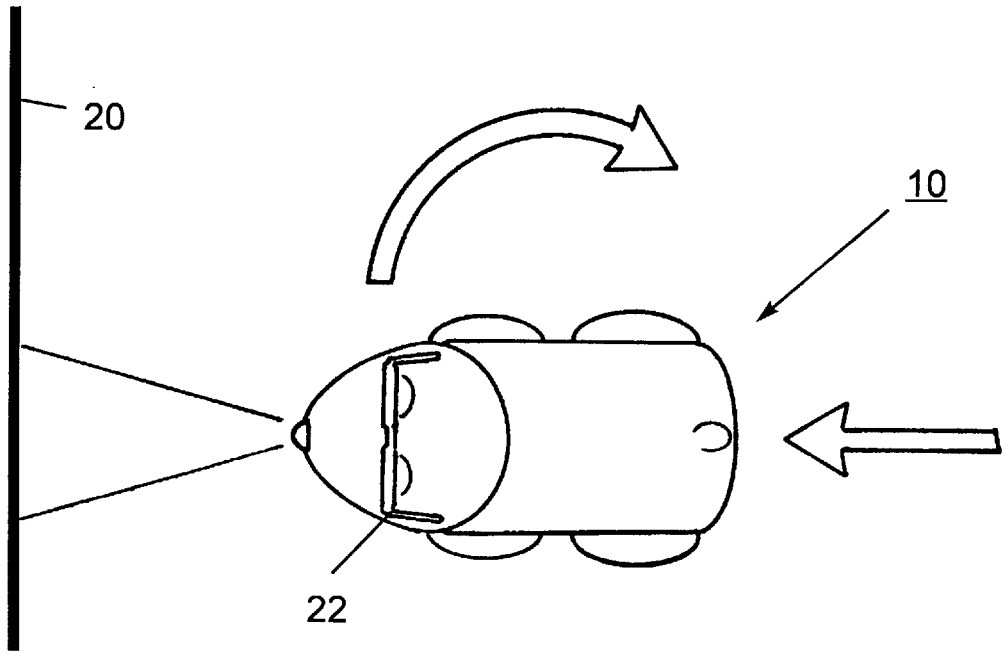
FIG. 4 is a top view of the toy operating in the mode shown in FIG. 2.

The toy dog 10 may move toward an object 20 such as a wall. The toy 10 may move relative to the object 20 in accordance with one of two modes. In the first mode shown in FIGS. 1 and 3, the toy dog 10 will move away from the object 20 when the dog 10 makes contact with the wall. In the second mode the toy dog 10 will move away from the object 20 when the dog 10 remotely senses the wall as shown in FIGS. 2 and 4.

The housing 12 may include eyewear 22 that can pivot relative to a head 24. The head 24 may have toy eyes 26. The position of the eyewear 22 corresponds to the mode of the toy 10. When the toy 10 is in the first mode the eyewear 22 is away from the eyes 26 as shown in FIGS. 1 and 3. When the toy 10 is in the second mode the eyewear 22 is adjacent to the eyes. With such an arrangement the dog 10 will remotely sense the object 20 and move while it is "wearing" the eyewear 22. In the first mode the dog 10 will not be wearing the eyewear 22 and will "crash" into the object 20 before moving, thus giving the appearance of being blind. Alternatively, the toy dog 10 may not move away from the object 20 in the first mode. With this embodiment the toy 10 would merely crash into the wall.

Figure 5:
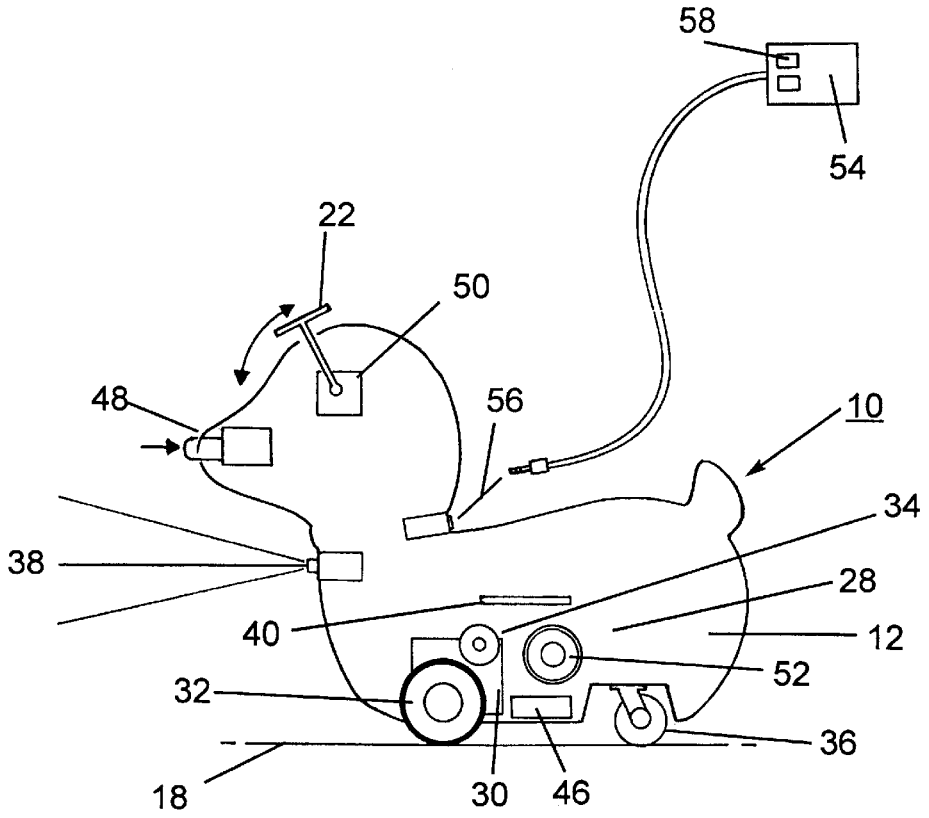
FIG. 5 is an illustration showing different components of the toy.
Figure 6:
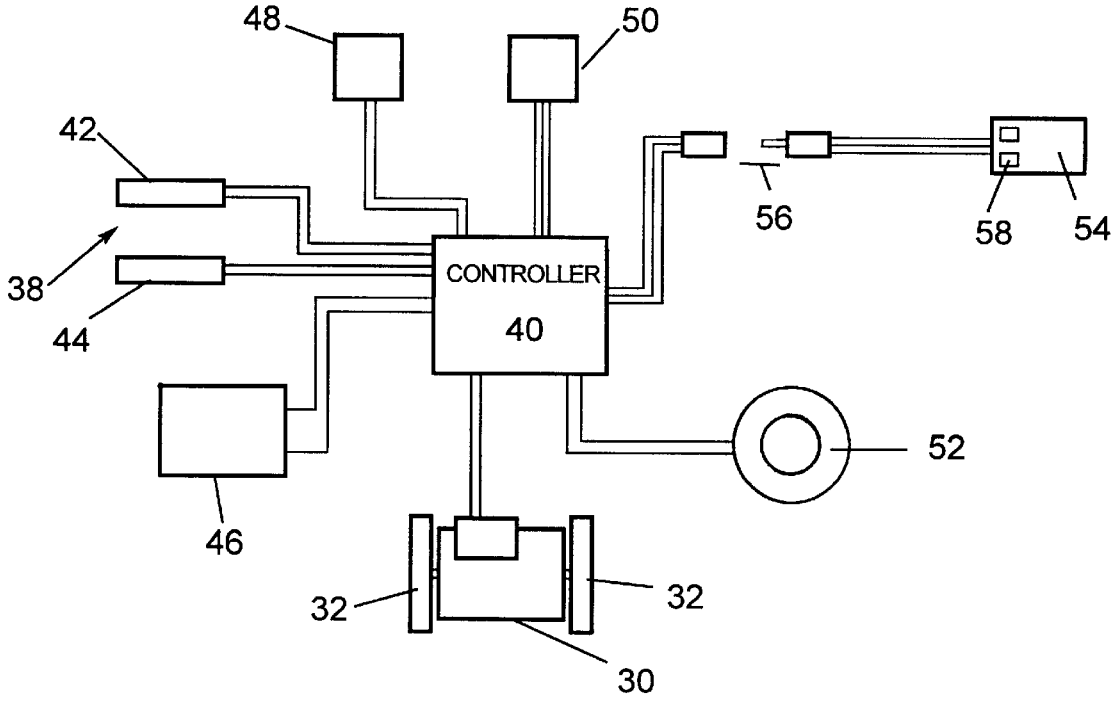
FIG. 6 is a schematic showing a system of the toy.

FIGS. 5 and 6 show an embodiment of the toy dog 10. The toy dog 10 may include a drive mechanism 28 that moves the body 12 relative to the surface 18. The drive mechanism 28 may include an electric motor 30 that rotates a pair of drive wheels 32 through a gear train assembly 34. The toy 10 may have a drive wheel 32 located on each side of the dog housing 12. Rotation of the drive wheel 32 moves the toy 10 across the surface 18. The gear train 34 may have clutches that allow only one drive wheel 30 to be engaged so that the toy 10 can turn as indicated in FIGS. 2 and 4. The toy dog 10 may have a caster wheel 36 to support the rear end of the housing 12 and allow pivotal movement of the toy 10.

The toy dog 10 may have a remote sensor assembly 38 that is connected to a controller 40. The controller 40 is also connected to the electric motor 30 and the drive train 34. The remote sensor assembly 38 may include a transmitter 42 and a receiver 44. The transmitter 42 may transmit a signal that is reflected from the object 20 and detected by the receiver 44. By way of example, the transmitter 42 and receiver 44 may transmit and detect light having an infrared wavelength.

The controller 40 may include a processor circuit, a memory circuit and associated interface circuits such as analog to digital (A/D) and digital to analog (D/A) circuits (not shown). The various circuits can process signals from the remote sensor assembly 38 to determine when the toy 10 is within a threshold proximity of the object 20, and provide corresponding signals to the electric motor 30 and drive train 34 to move the toy away from the wall. The process can be performed in accordance with instructions and data provided to the processor circuit. All of the electrical components of the toy 10 can be powered by a battery(ies) 46.

The toy 10 may also have a contact sensor 48 that is connected to the controller 40. The contact sensor 48 will provide output signal(s) when the sensor 48 engages the object 20. The output signal(s) is processed by the controller 40 which provides output signals to the drive train 34 so that the toy 10 moves away from the object 20. By way of example, the contact sensor 48 may be a proximity switch.

The eyewear 22 may be attached to a switch 50 that is connected to the controller 40. The end user may move the eyewear 22 into one of two positions which sets the mode of the toy. When the eyewear 22 is in the position shown in FIG. 2, the controller 40 will be in the second mode and only process data from the remote sensor assembly 38. When the eyewear 22 is in the position shown in FIG. 1, the controller 40 will be in the first mode and only process data from the contact sensor 48. By way of example, the switch 50 may be connected to an enable switch of a multiplexor which switches between a remote sensor channel and a contact sensor channel so that the processor receives data from one of the two sensors 38 or 48. Thus, in the first mode the remote sensor assembly 38 is de-coupled from the controller 40. In the second mode the sensor assembly 38 is coupled to the controller 40.

The toy 10 may include a speaker 52 that is connected to the controller 40. The controller 40 may provide signals to the speaker 52 to emit audible sounds in accordance with the processor program. For example, when the object 18 is detected through the remote sensor assembly 38 the speaker may emit the phrase "uh oh" before the toy is moved away from the wall.

The toy 10 may include a remote controller 54 that can be coupled to the controller 40 through a connector 56. The remote controller 54 may have a plurality of buttons 58 that can be manipulated by the end user to control the movement of the toy 10. The controller 40 may be configured so that input from the remote controller 54 overrides the signals from the sensors 38 or 48. Alternatively, the signals from the sensors 38 or 48 may override the signals from the remote controller 54 so that the toy 10 automatically moves relative to the object 18.

In operation, the end user turns on the toy 10 through a master "on-off" switch (not shown) and then moves the eyewear 22 to a desired position. The drive mechanism then moves the toy 10. If eyewear 22 is up as shown in FIG. 1, the toy 10 will move relative to the object only upon contact with the wall. If the eyewear 22 is down as shown in FIG. 2 the toy 10 will move relative to the object upon detection through the remote sensor assembly 38.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A toy, comprising:

a housing constructed to resemble an animal:

a drive mechanism that moves said housing in a first direction or a second direction;

a remote sensor;

a switch coupled to said housing and constructed to resemble eyewear, said switch being movable between a first position and a second position; and, a controller that is coupled to said remote sensor and controls said drive mechanism, said controller being in a first mode when said switch is in the first position and in a second mode when said switch is in a second position.

2. The toy of claim 1, further comprising a contact sensor that is coupled to said controller.

3. The toy of claim 1, wherein in said first mode said remote sensor is de-coupled from said controller, in said second mode said remote sensor is coupled to said controller.

4. The toy of claim 1, further comprising a remote controller that can be coupled to said controller and manipulated to change the direction of said housing.

5. The toy of claim 1, further comprising a speaker that is coupled to said controller.

6. The toy of claim 4, wherein said housing is constructed to resemble a dog.

7. A toy that can sense an object, comprising:

a housing:

a drive mechanism that moves said housing in a first direction or a second direction;

a remote sensor that senses the object;

a contact sensor that can engage the object;

a switch coupled to said housing and constructed to resemble eyewear, said switch being movable between a first position and a second position; and, a controller that is coupled to said remote and contact sensors and controls said drive mechanism, said controller and said drive mechanism change the direction of said housing when said remote sensor senses the object or said contact sensor engages the object, said controller can switch between a first mode and a second mode, said controller and said drive mechanism change the direction of said housing when said contact sensor engages the object when in the first mode, and changes the direction of said housing when said remote sensor senses the object when in the second mode; and, a speaker that is coupled to said controller.

8. The toy of claim 7, further comprising a remote controller that can be coupled to said controller and manipulated to change the direction of said housing.

9. The toy of claim 7, wherein said housing is constructed to resemble a dog.

10. A method for controlling a movement of a toy, comprising:

moving a toy toward an object;

moving a switch to a first position;

engaging the object;

moving away from the object;

moving the switch to a second position;

moving the toy toward the object;

sensing the object remotely without making contact with the object; and, moving the toy in a second direction away from the object.

11. The method of claim 10, moving the toy in the second direction when the toy engages the object.

12. The method of claim 11, switching the toy between a first mode wherein the toy moves in the second direction when the toy engages the object and a second mode wherein the toy moves in the second direction when the toy remotely senses the object.

13. The method of claim 12, wherein the toy is switched between the first and second modes by moving a switch of the toy.

* * * * *